US008714777B2

(12) United States Patent
Shimizu et al.

(10) Patent No.: US 8,714,777 B2
(45) Date of Patent: May 6, 2014

(54) OPTICAL DEVICE

(75) Inventors: Mikio Shimizu, Hyogo-ken (JP); Yoshio Okazaki, Hyogo-ken (JP)

(73) Assignee: Ushio Denki Kabushiki Kaisha, Tokyo-to (JP)

( * ) Notice: Subject to any disclaimer, the term of this patent is extended or adjusted under 35 U.S.C. 154(b) by 215 days.

(21) Appl. No.: 13/428,524

(22) Filed: Mar. 23, 2012

(65) Prior Publication Data

US 2012/0243238 A1 Sep. 27, 2012

(30) Foreign Application Priority Data

Mar. 25, 2011 (JP) ..... 2011-067170

(51) Int. Cl.
*F21V 7/04* (2006.01)
*F21V 13/04* (2006.01)

(52) U.S. Cl.
USPC ..... 362/263; 362/308; 362/268; 362/296.09; 362/296.05; 362/296.07; 353/102

(58) Field of Classification Search
USPC ..... 362/263, 308, 296.09, 296.05, 296.07, 362/347, 268; 353/102, 97
See application file for complete search history.

(56) References Cited

U.S. PATENT DOCUMENTS

| | | | | |
|---|---|---|---|---|
| 5,966,250 | A * | 10/1999 | Shimizu | 362/268 |
| 5,967,647 | A * | 10/1999 | Eichler | 362/304 |
| 6,231,193 | B1 * | 5/2001 | Sugawara | 353/102 |
| 6,997,565 | B2 | 2/2006 | Sekiguchi et al. | |
| 7,178,922 | B2 * | 2/2007 | Sekiguchi et al. | 353/102 |
| 2004/0021827 | A1 * | 2/2004 | Sekiguchi et al. | 353/20 |
| 2004/0070735 | A1 | 4/2004 | Sekiguchi et al. | |

FOREIGN PATENT DOCUMENTS

| | | |
|---|---|---|
| JP | 2002-214563 | 7/2002 |
| JP | 2002-298625 | 10/2002 |

* cited by examiner

*Primary Examiner* — Bao Q Truong
(74) *Attorney, Agent, or Firm* — Drinker Biddle & Reath LLP

(57) ABSTRACT

An optical device includes a high pressure discharge lamp, a concave condensing mirror placed so as to surround the high pressure discharge lamp while an optical axis stays extended along a direction of an arc of the high pressure discharge lamp, and an aspherical lens that is placed forward the light exit direction of the concave condensing mirror and that is rotationally symmetrical with respect to the optical axis of the concave condensing mirror, in which a reflecting surface of the concave condensing mirror is configured so as to have a shape set in connection with the shape of a light incident surface and the shape of a light exit surface of the aspherical lens.

4 Claims, 5 Drawing Sheets

OPTICAL DEVICE

CROSS-REFERENCE TO RELATED APPLICATIONS

This application claims the benefit of Japanese Patent Application No. 2011-067170, filed on Mar. 25, 2011, the entire contents of which are hereby incorporated by reference, the same as if set forth at length.

BACKGROUND OF THE INVENTION

1. Technical Field

The present invention relates to an optical device used as; for instance, a projector light source.

2. Description of the Related Art

An optical device is proposed as a light source used; for instance, in a projection display device like a liquid crystal projector, assembled by a combination of a discharge lamp with; e.g., an elliptical surface reflecting mirror. The optical device is configured in such a way that light emitted from the discharge lamp undergoes reflection on the elliptical surface reflecting mirror, to thus enter an arbitrary optical system; for instance, a rod integrator or an integrator lens (a fly-eye lens), and irridiate an irradiation surface thereof. There recently exists an increasing demand for a brighter projection screen of a liquid crystal projector.

As shown in FIG. 7, an elliptical surface reflecting mirror 40 has a function of condensing light emitted from a first focal point F1 into a second focal point F2. However, in the optical device using such an elliptical surface reflecting mirror 40, when light rays that have been emitted at equidensity from a discharge lamp situated at the first focal point F1 on the elliptical surface reflecting mirror 40 is condensed to the second focal point F2, a ray density tends to become smaller with an increasing distance from an optical axis X of the elliptical surface reflecting mirror 40. There is also a problem of an area where light rays do not travel because of shading of the discharge lamp (an outlined area) existing in the vicinity of the optical axis X.

As shown in FIG. 8, a comparative technique is proposed to address such a problems (see Patent Document 1 (JP-A-2002-298625)). Specifically, an aspherical lens 45 is disposed, in its light exit direction, ahead of a reflector 40A. A shape of a reflecting surface 41 of the reflector 40A is adjusted in accordance with a shape of a light incident surface 46 or a light exit surface 47 of the aspherical lens 45, thereby adjusting an outgoing light distribution appearing on the light exit surface 47 of the aspherical lens 45 in such a way that the ray density comes to an equidensity. It makes the outlined area caused by the shading of the discharge lamp smaller.

More specifically, the reflecting surface 41 of the reflector 40A is given a shape that makes smaller a ray density of light rays incident on the aspherical lens 45 near a light axis X of the reflector 40A. Further, angles of the light rays exiting from the aspherical lens 45 are adjusted by the aspherical lens 45, thereby making uniform the ray density achieved on the light exit surface 47 of the aspherical lens 45. Namely, an angular interval $d\phi$ between the light rays on the light exit surface 47 of the aspherical lens 45.

However, when the shape of the reflecting surface 41 of the reflector 40A is designed so as to achieve, on the light exit surface 47 of the aspherical lens 45, an outgoing light distribution that makes ray density into equidensity, the size of the arc of the discharge lamp viewed from points of reflection on the reflecting surface 41 of the reflector 40A is not taken into account. It turned out that, for this reason, arc images appearing at a condensing position Q fail to assume constant size, which sometimes leads to a decrease in use efficiency of light and gives rise to a problem of generation of insufficient illuminance. Specifically, as shown in FIG. 9, when light rays emitted from tip ends 42*a* and 42*b* of respective electrodes enter an arbitrary reflecting position $R_5$ on the reflecting surface 41, the light rays reflected at the reflecting position $R_5$ enter the aspherical lens 45 while an angle $\alpha$ between the light rays achieved when the light rays enter the reflecting position $R_5$ is maintained. Subsequently, an image based on the light rays from tip ends 42*a* and 42*b* is formed in size A at the condensing position Q. In the meantime, the light rays emitted from the tip ends 42*a* and 42*b* of the respective electrodes enter an arbitrary reflecting position $R_6$ on the reflecting surface 41, the light rays reflected at the reflecting position $R_6$ enters the aspherical lens 45 while an angle $\beta$ ($>\alpha$) between the light rays achieved when the light rays enter the reflecting position $R_6$ is maintained. Subsequently, an image is formed at the condensing position Q. When ray density achieved on the light exit surface 47 of the aspherical lens 45 is made into equidensity, the image will be formed in a different size B (>A) at the condensing position Q. As a consequence, some of the light rays originating from the reflecting position $R_6$ often fail to enter an aperture 50, which in turn generates unavailable light rays.

SUMMARY OF THE INVENTION

An illustrative aspect of the invention is to provide an optical device capable of yielding a high use efficiency of light and high illuminance.

According to an aspect of the invention, an optical device comprises: a high pressure discharge lamp; a concave condensing mirror that is placed so as to surround the high pressure discharge lamp while an optical axis of the concave condensing mirror stays extended along a direction of an arc of the high pressure discharge lamp; and an aspherical lens that is placed forward a light exit direction of the concave condensing mirror and that is rotationally symmetrical with respect to the optical axis of the concave condensing mirror, in which: a reflecting surface of the concave condensing mirror is configured to have a shape set in connection with a shape of a light incident surface and a shape of a light exit surface of the aspherical lens in such a way that there is exhibited an outgoing light distribution in which a ray density of certain light rays becomes minimum at a position on the light exit surface of the aspherical lens where the certain light rays, which undergo reflection at a reflecting position perpendicular to an optical axis of the concave condensing mirror passing through an arc center of the high pressure discharge lamp, exit out of the light exit surface of the aspherical lens.

In the optical device, it may be that provided that an angle which a direction of a light ray traveling from the arc center of the high pressure discharge lamp toward an arbitrary reflecting position on the reflecting surface of the concave condensing mirror forms with the optical axis of the concave condensing mirror is $\theta$, the outgoing light distribution appearing on the light exit surface of the aspherical lens is that ray density change with $\sin\theta$ in such a way that the ray density becomes greater with an increasing distance from the position where the ray density becomes minimum toward a brim of the aspherical lens and a center axis of the same.

In the optical device, it may be that the reflecting surface of the concave condensing mirror is formed by a plurality of micro surface constituting reflectors continually placed at angles respectively set with respect to the optical axis of the concave condensing mirror.

In the optical device, it may be that the micro surface constituting reflectors forming the reflecting surface of the concave condensing mirror are 1000 or more.

With the optical device, it is configured so as to exhibit an outgoing light distribution, such as that will be described below. Specifically, by a function of a reflecting surface of the concave condensing mirror whose shape is adjusted in connection with the shape of the light incident surface and the shape of the light exit surface of the aspherical lens and a function of the light incident surface and/or action of the light exit surface of the aspherical lens, there becomes minimum the ray density achieved at the position on the light exit surface of the aspherical lens where the light rays, which are reflected at the reflecting position on the reflecting surface of the concave condensing mirror perpendicular to the optical axis of the arc center, exit out of the light exit surface of the aspherical lens. Arc images appearing at arbitrary reflecting positions on the reflecting surface of the concave condensing mirror can be made to assume a substantially equal luminous flux diameter. Accordingly, the use efficiency of light becomes higher, and sufficiently high illuminance can be yielded.

BRIEF DESCRIPTION OF THE DRAWINGS

FIGS. 6A and 6B are explanatory views showing another example configuration of the aspherical lens included in the optical device of the present invention along with light ray tracings, in which FIG. 6A shows an aspherical lens exhibiting a collimating characteristic and FIG. 6B shows an aspherical lens exhibiting a divergent characteristic;

DETAILED DESCRIPTION OF EMBODIMENTS OF THE INVENTION

An embodiment of the present invention is hereunder described in detail.

Figure 1:
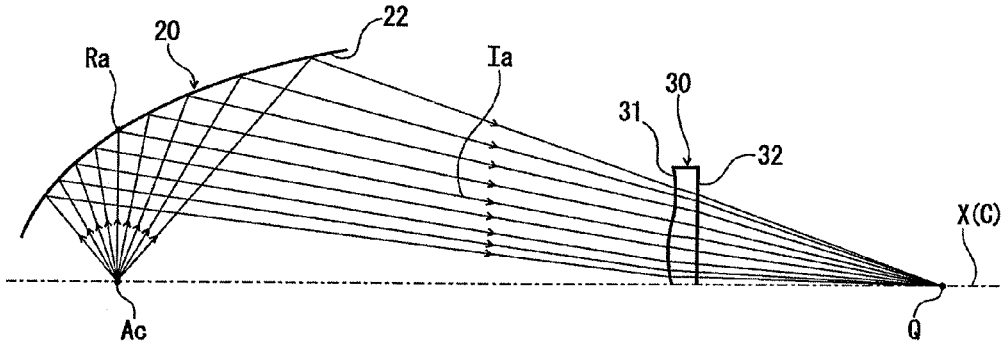
FIG. 1 is an explanatory view showing a rough configuration of an example optical device of the present invention along with light ray tracings of light emitted from a high pressure discharge lamp.
Figure 2:
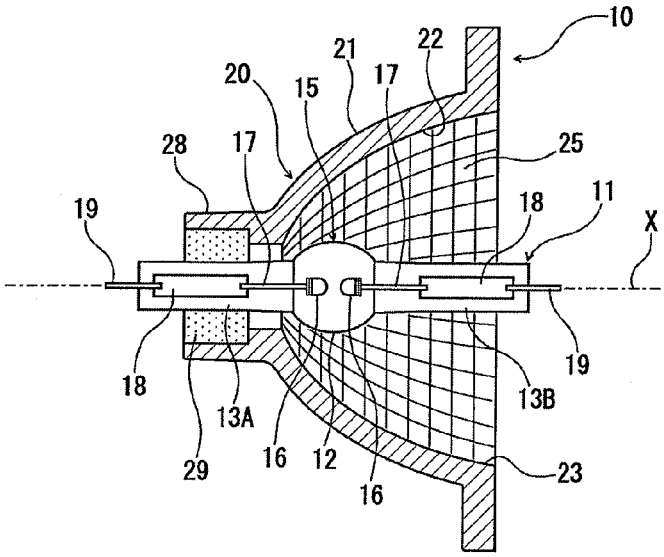
FIG. 2 is an explanatory cross sectional view showing a rough configuration of an example light source included in the optical device of the present invention.

FIG. 1 is an explanatory view showing a rough configuration of an example optical device of the present invention along with light ray tracings of light emitted from a high pressure discharge lamp, and FIG. 2 is an explanatory cross sectional view showing a rough configuration of an example light source included in the optical device of the present invention.

The optical device of the present embodiment includes a light source unit 10 and an aspherical lens 30. The light source unit 10 includes a high pressure discharge lamp 11 of for instance, alternating-current lighting type, and a concave condensing mirror 20 that is placed so as to enclose the high pressure discharge lamp 11 while an optical axis X of the concave condensing mirror 20 extends along a direction of an arc of the high pressure discharge lamp 11. The aspherical lens 30 is disposed forward of the concave condensing mirror 20 in a light exit direction and is rotationally symmetrical about the optical axis of the concave condensing mirror 20. The light emitted from the high pressure discharge lamp 11 is irradiated by way of an aperture 50 (see FIG. 5), which is set to a size, while being condensed by the concave condensing mirror 20 and the aspherical lens 30.

The high pressure discharge lamp 11 included in the light source unit 10 is built from; for instance, a super high pressure mercury lamp, and has a discharge container 15. The discharge container 15 is made from; for instance, vitreous silica, and includes a spherical arc tube 12 and rod-shaped sealings 13A and 13B continually connected to respective ends of the arc tube 12.

A pair of electrodes 16 is placed opposite to each other within the arc tube 12 along a tube axis of the discharge container 15. A distance between the electrodes 16 is; for instance, 0.5 mm to 2.0 mm; and set to; e.g., 1.0 mm, in the embodiment. Each of the electrodes 16 includes an electrode rod-shaped portion 17 electrically connected to a rod-shaped external lead 19 by way of metal foil 18. Each of the electrode rod-shaped portion 17 extends along the tube axis of the discharge container 15. The metal foil 18 made from; for instance, molybdenum, is hermetically buried in each of the sealings 13A and 13B. Further, each of the external leads 19 axially projects out of an external end of each of the sealings 13A and 13B.

Mercury serving as a luminous material and a noble gas serving as a buffer gas are sealed the arc tube 12.

A quantity of mercury sealed is 0.05 $mg/mm^3$ or more; for instance, 0.08 $mg/mm^3$, in the embodiment. When the light source unit is used as a light source for a projector, a quantity of sealed mercury should preferably be 0.15 $mg/mm^3$ or more.

The noble gas is; for instance, an argon gas, and a quantity of noble gas sealed is; for instance, 10 kPa.

The concave condensing mirror 20 in the light source unit 10 includes a reflecting portion 21 that severs as a base material made from glass; for instance, borosilicate glass, and that forms a reflection space for reflecting light emitted from the high pressure discharge lamp 11. A reflecting surface 22 is formed over an interior surface of the reflecting portion 21. Specifically, the concave condensing mirror 20 includes the reflecting portion 21 and a cylindrical neck portion 28. The reflecting portion 21 assumes an elliptical external shape when viewed in a cross section including an optical axis X, and a light exit 23 opened in the forward direction (a right side in FIG. 2) is formed in the reflecting portion 21. The cylindrical neck portion 28 is formed at a center area so as to continually extend from a rear end (a left end in FIG. 2) of the reflecting portion 21 in a backward direction (right side in FIG. 2) along the optical axis. The sealing 13A of the high pressure discharge lamp 11 is inserted into the cylindrical neck portion 28. An adhesive 29 fills in a gap between an external circumferential surface of the sealing 13A and an internal circumferential surface of the cylindrical neck portion 28. In this way, the sealing 13A is fixed to the concave condensing mirror 20 while the optical axis X of the concave condensing mirror 20 extends along the direction of the arc of the high pressure discharge lamp 11.

The reflecting surface 22 of the concave condensing mirror 20 is formed by tightly, continually arranging a plurality of micro surface constituting reflectors 25 over the interior surface of the reflecting portion 21 serving as the base material. The respective micro surface constituting reflectors 25 are arranged at respective angles (angles for reflecting light rays incident on the respective micro surface constituting reflectors 25) set with respect to the optical axis X of the concave condensing mirror 20. The reflecting surface 22 is given a shape that exhibits a specific outgoing light distribution on the light exit surface 32 of the aspherical lens 30, which will be described later.

Each of the micro surface constituting reflectors 25 is formed from a convex curved mirror that employs; for instance, a convex surface, as a mirror surface. A dielectric multilayer that has an overall thickness of 0.5 to 10 micrometers and that is formed by alternately laminating; for instance, a silica ($SiO_2$) layer and a titanium ($TiO_2$) layer one on top of the other is formed over the surface of the reflecting surface 22.

A preferred number of the micro surface constituting reflectors 25 is 1000 or more, whereby the outgoing light distribution appearing on the light exit surface 32 of the aspherical lens 30 can accurately be controlled.

The aspherical lens 30 in the optical device of the present embodiment is made up of; for instance, borosilicate glasses [e.g., "BK7," TEMPAX (Registered Trademark), and the like], vitreous silica, and others. The aspherical lens 30 exhibits a light condensing characteristic. The aspherical lens 30 has a lens surface of a light incident surface 31 which light from the light source unit 10 enters and which has convex and concave portions. Further, the aspherical lens 30 has a lens surface of the light exit surface 32 having a planar shape. The aspherical lens 30 is disposed with its center axis C held in line with the optical axis X of the concave condensing mirror 20 in the light source unit 10.

In the optical device, a shape of the reflecting surface 22 in the concave condensing mirror 20 is determined from a relationship with a shape of the light incident surface 31 of the aspherical lens 30 as follows. Namely, an outgoing light distribution appearing on the light exit surface 32 of the aspherical lens 30 shows that light rays reflected at a reflecting position Ra which is at the arc center Ac of the high pressure discharge lamp 11 and at right angles with respect to the optical axis of the concave condensing mirror 20 exhibit the minimum ray density at a position where the light rays exit from the light exit surface 32 of the aspherical lens 30. Specifically, the reflecting surface 22 of the concave condensing mirror 20 assumes the following shape. Namely, given that an angle which the direction of the light ray traveling from the arc center Ac of the high pressure discharge lamp 11 toward an arbitrary reflecting position on the reflecting surface 22 of the concave condensing mirror 20 forms with the optical axis X of the concave condensing mirror 20 is θ, the outgoing light distribution appearing on the light exit surface 32 of the aspherical lens 30 shows that the ray density changes with sin θ in such a way that the ray density becomes greater with an increasing distance from the position where the ray density becomes minimum toward a brim of the aspherical lens 30 and the center axis C of the same. An effective reflection region of the concave condensing mirror 20 corresponds to; for instance, $40° \leq \theta \leq 150°$. The reason why the reflecting surface 22 of the concave condensing mirror 20 assumes such a shape is as follows.

Figure 3:
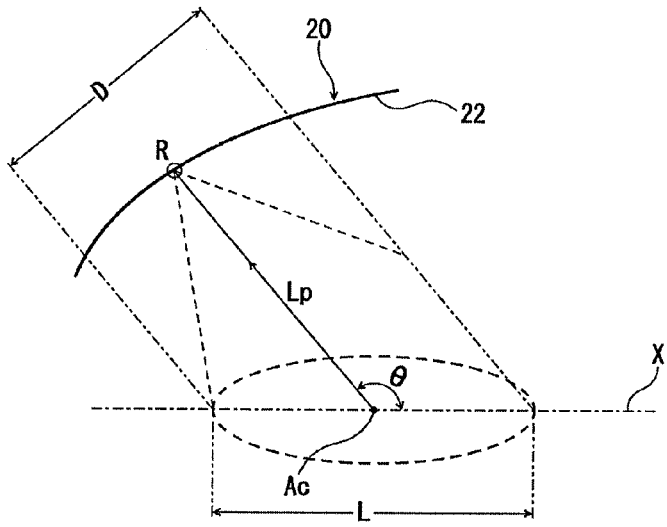
FIG. 3 is an explanatory view for explaining a relationship between an angle θ which a direction of a light ray traveling toward an arbitrary reflecting position on a reflecting surface from an arc center forms with an optical axis of a concave condensing mirror and a size D of the arc viewed from the reflecting position.

In the high pressure discharge lamp 11 serving as a point light source, an arc developing between the electrodes 16 assumes, in effect, a size. Accordingly, a size of the arc viewed from a reflection position on the reflecting surface 22 of the concave condensing mirror 20 must be taken into account in order to control an outgoing light distribution on the light exit surface 32 of the aspherical lens 30. Specifically, as shown in FIG. 3, provided that an angle (hereinafter called an "emission angle") which a direction Lp of a light ray traveling from the arc center Ac toward a reflecting position R forms with the optical axis X of the concave condensing mirror 20 is θ and that a length of the arc achieved along the direction of the optical axis of the concave condensing mirror 20 is L, a size D of the arc (a region surrounded by broken lines in FIG. 3) acquired at an arbitrary reflecting position R on the reflecting surface 22 of the concave condensing mirror 20 can be expressed as $D=L\times\sin\theta$. From this expression, the arc size D acquired at the arbitrary reflecting position R on the reflecting surface 22 of the concave condensing mirror 20 is considered to change in proportion to sin θ. Accordingly, the essential requirements to make the size of an arc image formed at a condensing position Q constant are to set the outgoing light distribution appearing on the light exit surface 32 of the aspherical lens 30 in such a way that the ray density changes along with sin θ. According to the relational expression, the arc size D becomes maximum at $\theta=90°$. Therefore, the outgoing light distribution appearing on the light exit surface 32 of the aspherical lens 30 is set in such a way that the ray density achieved at a position where the light rays, which undergo reflection at the reflecting position Ra on the reflecting surface 22 of the concave condensing mirror 20 that is perpendicular to the optical axis X of the concave condensing mirror 20 at the arc center Ac, exit out of the light exit surface 32 of the aspherical lens 30 becomes minimum and that the ray density becomes greater with an increasing distance toward a brim of the aspherical lens 30 as well as the center axis C of the aspherical lens 30.

Figure 4:
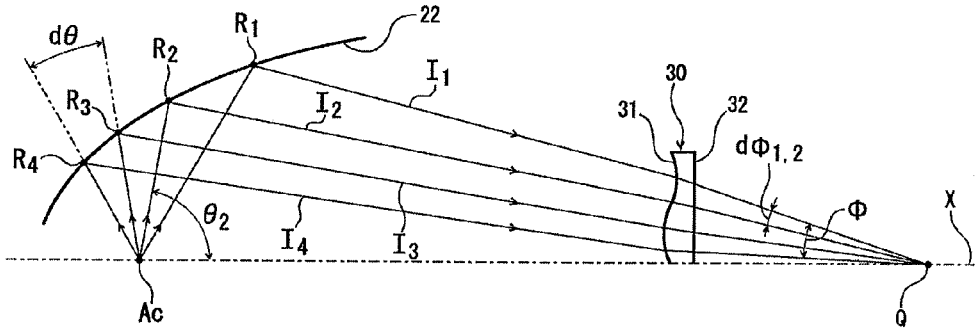
FIG. 4 is an explanatory view showing a relationship between an angle which a direction of the light ray traveling to the arbitrary reflecting position on the reflecting surface from the arc center forms with the optical axis of the concave condensing mirror and an angular interval between light rays emitted from a light exit surface of an aspherical lens.

Positioning angles of the respective micro surface constituting reflectors 25 forming the reflecting surface 22 of the concave condensing mirror 20 are set as follows. As shown in FIG. 4, in order to facilitate comprehension of the settings, an explanation is given by means of taking the following case as an example. Specifically, four light rays $I_1$ to $I_4$ emitted at equal angular interval dθ from the arc center Ac of the high pressure discharge lamp, which serves as a point light source, converge to the condensing position Q within a converging angle limit (an angle existing between the outermost light ray and the innermost light ray) Φ. A value of an angular interval $d_{\Phi 1,2}$ existing between an angle—at which the light ray $I_1$ that undergoes reflection at a reflecting position $R_1$ on the reflecting surface 22 of the concave condensing mirror 20 and that is emitted from the arc center Ac at the minimum emission angle ($\theta_2$−dθ), exits from the light exit surface 32 of the aspherical lens 30—and an angle—at which the light ray $I_2$ that undergoes reflection at a reflecting position $R_2$ on the reflecting surface 22 and that is emitted from the arc center Ac at an emission angle ($\theta_2$), exits from the light exit surface 32 of the aspherical lens 30—is calculated according to Equation 1 provided below (when "k" in Equation 1 assumes a value of 2). Positioning angles of the micro surface constituting reflectors 25 with respect to the optical axis X of the concave condensing mirror 20 are set in relation to the shape of the light incident surface 31 of the aspherical lens 30 in such a way that the micro surface constituting reflectors 25 placed at the reflecting position $R_1$ and the reflecting position $R_2$ reflects the light rays $I_1$ and $I_2$ to respective points of intersection, in the range of the converging angle limit Φ, between two lines extended from the condensing position Q at the angular interval $d_{\Phi 1,2}$ and the position where the aspherical lens 30 is placed along the direction of the optical axis. Such operation is performed in connection with light rays $I_3$ and $I_4$ that undergo reflection at reflecting positions $R_3$ and $R_4$ on the reflecting surface 22 and that are emitted at emission angles ($\theta_2$+dθ, $\theta_2$+2dθ) from the arc center Ac, whereby there are determined the positioning angles of the micro surface constituting reflectors 25 set at the respective reflecting positions $R_3$ and $R_4$. Thus, continual shape data pertaining to the reflecting surface 22 of the concave condensing mirror 20 can be acquired. It is preferable that the shape of the reflecting surface 22 of the concave condensing mirror 20 be adjusted (set) in such a way that the number of light rays is 1000 or more. Put another word, the reflecting surface 22 is formed by the micro surface constituting reflectors 25 of 1000 or more. Adjustment of the outgoing light distribution on the light exit surface 32 of the aspherical lens 30 can thereby be accurately performed, so that a desired effect can reliably be yielded.

The shape of the light incident surface 31 of the aspherical lens 30 can be set on the basis of a relationship between an incident angle and an exit angle of the light ray and according to a refractive index of a material making up the aspherical lens 30.

[Mathematical Expression 1]

$$d_{\Phi k-1,k} = \frac{M \times \Phi - \sum_{i=1}^{M-1} S_i}{N-1} \sin\theta_k$$

where, $\theta_k$ denotes an angle which a light ray "k" forms with an optical axis of the concave condensing mirror;

S denotes a summation of angular intervals $d_{\Phi 1,2}$ to $d_{\Phi N-1,N}$;

N denotes the number of light rays, wherein symbol "k" denotes an integer ranging from two to N; and M denotes the number of times there are performed operation for determining a difference between S and Φ until S≈Φ is achieved, dividing the difference so as to become proportional to sin $\theta_k$, and adding a result to $d_{\Phi 1,2}$ to $d_{\Phi N-1,N}$.

Expression 1 is obtained as follows. First, there is determined an angle at which a light ray $I_1$, which is emitted from the arc center Ac at the minimum emission angle ($\theta_2$−dθ) and which undergoes reflection at the reflecting position $R_1$ on the reflecting surface 22 of the concave condensing mirror 20, exits out of the light exit surface 32 of the aspherical lens 30. There is also determined an angle at which a light ray $I_2$, which is emanated from the arc center Ac at the emission angle $\theta_2$ and which undergoes reflection at the reflecting position $R_2$ on the reflecting surface 22 of the concave condensing mirror 20, exits out of the light exit surface 32 of the aspherical lens 30. When made proportional to sin $\theta_2$ by means of action of the reflecting surface 22 of the concave condensing mirror 20 and the light incident surface 31 of the aspherical lens 30, an angular interval $d_{\Phi,1,2}$ between the angles is given by Equation 2 provided below. The same also applies to an angular interval $d_{\Phi 2,3}$ between the light ray $I_2$ and a light ray $I_3$ that exit out of the light exit surface 32 of the aspherical lens 30 and an angular interval $d_{\Phi 3,4}$ between the light ray $I_3$ and a light ray $I_4$ that exit out of the light exit surface 32 of the aspherical lens 30. The angular interval $d_{\Phi 2,3}$ is given by an angle ($\theta_2$+dθ) which a direction along which the light ray $I_3$ travels toward the reflecting position $R_3$ on the reflecting surface 22 of the concave condensing mirror 20 forms with the optical axis X of the concave condensing mirror 20. Further, the angular interval $d_{\Phi 3,4}$ is given by an angle ($\theta_2$+2dθ) which a direction along which the light ray $I_4$ travels toward the reflecting position $R_4$ on the reflecting surface 22 of the concave condensing mirror 20 forms with the optical axis X of the concave condensing mirror 20.

[Mathematical Expression 2]

$$d_{\Phi 1,2} = \frac{\Phi}{4-1} \sin\theta_2$$

Since a value of each of sin $\theta_2$, sin($\theta_2$+dθ), and sin($\theta_2$+2dθ) is one or less, a summation $S_1$ (=$d_{\Phi 1,2}$+$d_{\Phi 2,3}$+$d_{\Phi 3,4}$) of the angular intervals among the light rays $I_1$ to $I_4$ exiting out of the light exit surface 32 of the aspherical lens 30 comes to $S_1$<Φ. Therefore, a difference between the summation $S_1$ of the angular intervals among the light rays $I_1$ to $I_4$ exiting out of the light exit surface 32 of the aspherical lens 30 and the converging angle limit Φ is also divided so as to become proportional to sin $\theta_k$, and a result of division must be added to $d_{\Phi 1,2}$, $d_{\Phi 2,3}$, and $d_{\Phi 3,4}$. Accordingly, the angular interval $d_{\Phi 1,2}$ is given by Equation 3 provided below, and a summation $S_2$ of angular intervals among the light rays $I_1$ to $I_4$ exiting out of the light exit surface 32 of the aspherical lens 30 is given by Equation 4.

[Mathematical Expression 3]

$$d_{\Phi 1,2} = \frac{\Phi}{4-1} \sin\theta_2 + \frac{\Phi + S_1}{4-1} \sin\theta_2$$

[Mathematical Expression 4]

$$S_2 = d_{\Phi 1,2} + d_{\Phi 2,3} + d_{\Phi 3,4} = S_1 + \sum_{i=2}^{4} \frac{\Phi - S_1}{4-1} \sin\theta_2$$

In Expression 4, a value of sin $\theta_2$ is one or less, and therefore $S_2$<Φ is obtained. Accordingly, a difference between a summation $S_M$ of $d_{\Phi 1,2}$, $d_{\Phi 2,3}$, and $d_{\Phi 3,4}$ and the converging angle limit Φ is divided so as to become proportional to sin θ, and operation for adding a result of division to each of $d_{\Phi 1,2}$, $d_{\Phi 2,3}$, and $d_{\Phi 3,4}$ is iterated; for instance, M times. Provided that the summation $S_M$ and the converging angle limit Φ become substantially equal to each other ($S_M$≈Φ), the summation $S_M$ of the angular intervals among the respective light rays $I_1$ to $I_4$ exiting out of the light exit surface 32 of the aspherical lens 30 is given by Expression 5 provided below. The angular interval $d_{\Phi 1,2}$ between the light ray $I_1$ and the light ray $I_2$ is given by Expression 6 provided below. Expression 1 is derived from Expression 6.

[Mathematical Expression 5]

$$S_M = S_{M-1} + \sum_{i=2}^{4} \frac{\Phi - S_{M-1}}{4-1} \sin\theta_i$$

[Mathematical Expression 6]

$$d_{\Phi 1,2} = \frac{M \times \Phi - \sum_{i=1}^{M-1} S_i}{4-1} \sin\theta_2$$

As mentioned above, in the optical device, the shape of the reflecting surface 22 of the concave condensing mirror 20 is determined in consideration of the size of an arc acquired when the arc is viewed from an arbitrary reflecting position on the reflecting surface 22 of the concave condensing mirror 20.

Specifically, provided that an angle which the direction of the light ray traveling from the arc center Ac of the high pressure discharge lamp 11 toward an arbitrary reflecting position on the reflecting surface 22 of the concave condensing mirror 20 forms with the optical axis X of the concave condensing mirror 20 is θ, the shape is determined so as to exhibit an outgoing light distribution by means of which the ray density changes with sin θ; that is, the ray density becomes greater with an increasing distance from a position on the light exit surface 32 of the aspherical lens 30 where the ray density becomes minimum toward a position on the brim of the aspherical lens 30 and a position closer to the center axis C of the aspherical lens 30.

Figure 5:
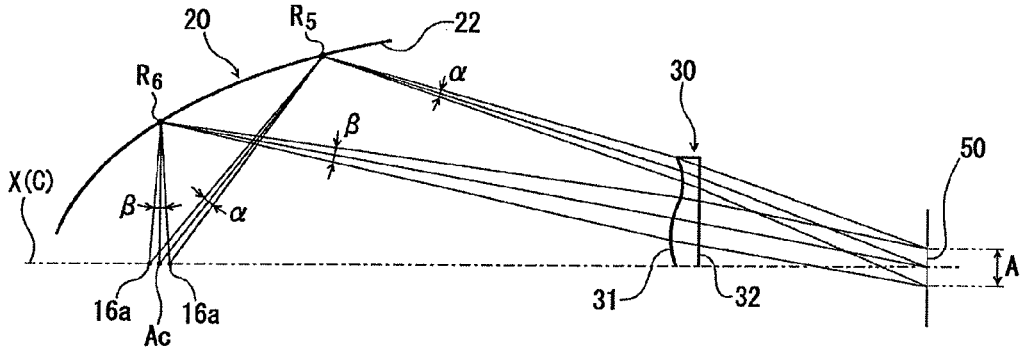
FIG. 5 is an explanatory view showing light ray tracings of light rays emitted from tip ends of respective electrodes in the optical device shown in FIG. 1.

As shown in FIG. 5, when the light rays emanated from tip ends 16*a* and 16*a* of the respective electrodes enter a reflecting position $R_5$ on the reflecting surface 22, the light rays reflected at the reflecting position $R_5$ enter the light incident surface 31 of the aspherical lens 30 while an angle α between the light rays achieved when the light ray enters the reflecting position $R_5$ is maintained. Subsequently, an arc image is formed in size A at the condensing position Q. When the light rays emanated from the respective tip ends 16*a* and 16*a* of the respective electrodes enter an arbitrary reflecting position $R_6$ on the reflecting surface 22, the light rays reflected at the reflecting position $R_6$ enter the light incident surface 31 of the aspherical lens 30 while an angle β (>α) between the light rays achieved when the light ray enters the reflecting position $R_6$ is maintained. Subsequently, an image is formed at the condensing position Q. An arc image of size A is formed at the condensing position Q by means of action of the reflecting surface 22 of the concave condensing mirror 20 and the light incident surface 31 of the aspherical lens 30 adjusted to a specific shape.

Figure 9:
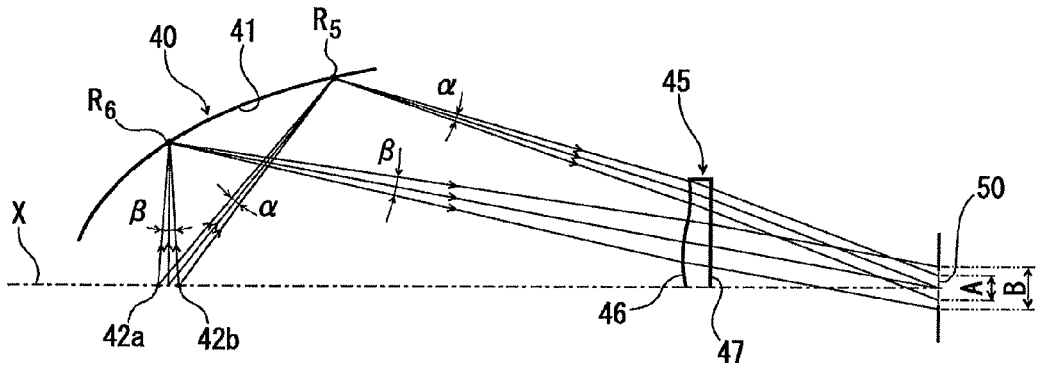
FIG. 9 is an explanatory view showing light ray tracings of light rays emitted from tip ends of respective electrodes in the optical device shown in FIG. 8.

Specifically, when the light rays reflected at the reflecting position $R_5$ on the reflecting surface 22 are made greater than those achieved when the light rays exit, at equal ray densities, out of a position in the vicinity of the light exit surface 32 of the aspherical lens 30 corresponding to the reflecting position $R_5$ (see FIG. 9), the image is formed at the condensing position Q as an arc image that is greater than that formed when the light rays exit out of the light exit surface 32 of the aspherical lens 30 while the outgoing light distribution exhibits equidensities. The light rays that undergo reflection at the reflecting position $R_6$ on the reflecting surface 22 are made smaller than those achieved when the light rays exit at equal ray density from a position on the light exit surface 32 of the aspherical lens 30 corresponding to the reflecting position $R_6$ (see FIG. 9). Therefore, the light rays form, at the condensing position Q, an ark image that is smaller than that achieved when light rays exit while equidensity are exhibited by the outgoing light distribution on the light exit surface 32 of the aspherical lens 30. An arc image of a size A is thereby formed at the condensing position Q within the size of the aperture 50.

Accordingly, in the optical device having the above configuration, the arc image assumes a constant size at the condensing position Q. The light rays that cannot enter the aperture 50 for reasons of the size of the arc of the high pressure discharge lamp 11 can be utilized, so that use efficiency of the light is enhanced. As a result, sufficiently high illuminance can be acquired.

As mentioned above, in the optical device having the above configuration, the arc image assumes a constant size at the condensing position. Hence, the optical device enables effective use of a compact optical member; for instance, a rod integrator and an integrator lens. Therefore, the optical device becomes useful as a light source for a projector; for instance, an LCD projector. In such a projector, arc images reflected at arbitrary reflecting positions on the concave condensing mirror can be made to have substantially an identical luminous flux diameter on; for instance, an incident surface of an integrator lens. Hence, the use efficiency of light is enhanced as a result of elimination of light that goes outside the incident surface of the integrator lens. As a consequence, sufficient brightness can be achieved on a projection screen of the projector.

Example tests conducted to check the advantages of the present invention are described below.

First Example Test

The optical device of the present invention was manufactured in accordance with the configurations shown in FIGS. 1 and 2. Specifications of respective constituent members are as follows.

[Specifications of the High Pressure Discharge Lamp]

Discharge container: a material; vitreous silica, the maximum outside diameter of the arc tube; ϕ12 mm, a thickness of the arc tube; 3.2 mm, an inner volume of the arc tube; 75 $mm^3$, A distance between electrodes: 1.0 mm, A quantity of sealed mercury: 0.15 $mg/mm^3$, a quantity of enclosed argon (a rare gas): 10 kPa, A rated voltage: 75 V, and rated power consumption: 300 W,

[Specifications of the Concave Condensing Mirror]

A base material: borosilicate glass

An opening size of a light exit opening: Φ52 mm, a length of the reflecting section achieved along the optical axis: 28 mm, Micro surface constituting reflectors forming the reflecting surface: convex curve mirrors, the number of convex curve mirrors: 1000

A position: a position where an arc center position of the high pressure discharge lamp is situated inside, by 21 mm, from an end face of the light exit opening with reference to the optical axis.

[Specifications of the Aspherical Lens]

A material: borosilicate glass [TEMPAX (Registered Trademark)], a refractive index: 1.47, A position: a position that is located outside by 25 mm from the end face of the light exit opening of the concave condensing mirror with reference to the optical axis, A condensing position: a position that is located outside the optical axis by 30 mm from the light exit surface A shape of the reflecting surface of the concave condensing mirror and a shape of the light incident surface of the aspherical lens: a shape that exhibits an outgoing light distribution by means of which a ray density changes with sin θ in such a way that the ray density becomes minimum at a position on the light exit surface of the aspherical lens where the light rays reflected at a reflecting position on that reflecting surface of the concave condensing mirror, which is perpendicular to the optical axis of the arc center (θ=90°), exit out of the light exit surface of the aspherical lens and that the ray density becomes greater with an increasing distance from the position toward the center axis and the brim of the aspherical lens, The minimum ray density (a relative value) achieved when the maximum ray density achieved on the light exit surface of the aspherical lens is taken as one: 0.64

An effective reflecting region: 40°≤θ≤140°

In relation to the thus-manufactured optical device of the present invention, there was manufactured an optical device for comparison purpose having the same configuration as that of the optical device except the fact that there is employed, as an concave condensing mirror, a mirror in which the reflecting surface of the concave condensing mirror assumes a shape that exhibits an outgoing light distribution by means of which a ray density on the light exit surface of the aspherical lens comes into equidensity in connection with the shape of the light incident surface of the aspherical lens.

In the optical device of the present invention and the optical device for comparison purpose, a rod-shaped integrator lens in which the light incident surface has an outside diameter of ϕ3 mm is placed at the condensing position on the aspherical lens. The illuminance of light emanated from the integrator lens was measured. The measurement shows that the optical device of the present invention emits illuminance that is higher, by about three percents, than that emitted by use of the comparative optical device.

Although the present embodiment of the present invention has been described thus far, the present invention is not limited to the embodiment and is susceptible to various modifications.

For instance, in the optical device of the present invention, the aspherical lens can be embodied as a lens whose light exit surface has irregularities. Further, both the light incident surface and the light exit surface of the aspherical lens can be formed as lens surfaces having irregularities.

Figure 6A:
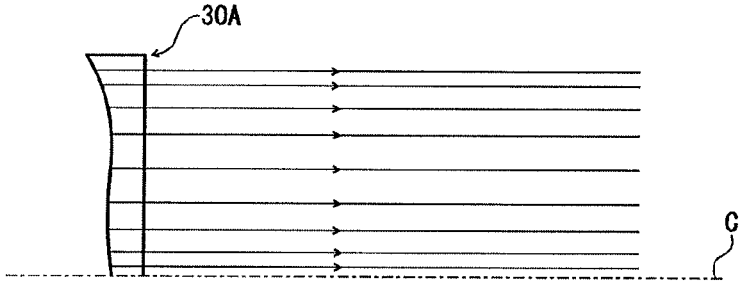
Figure 6B:
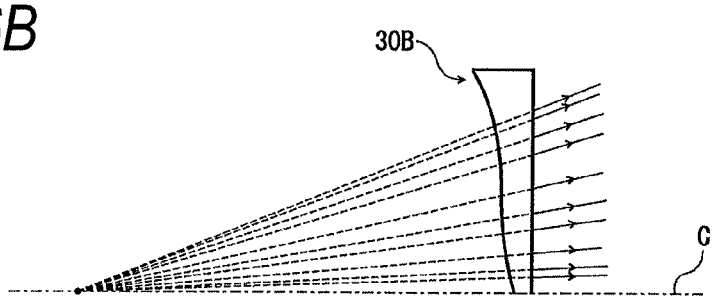
Figure 7:
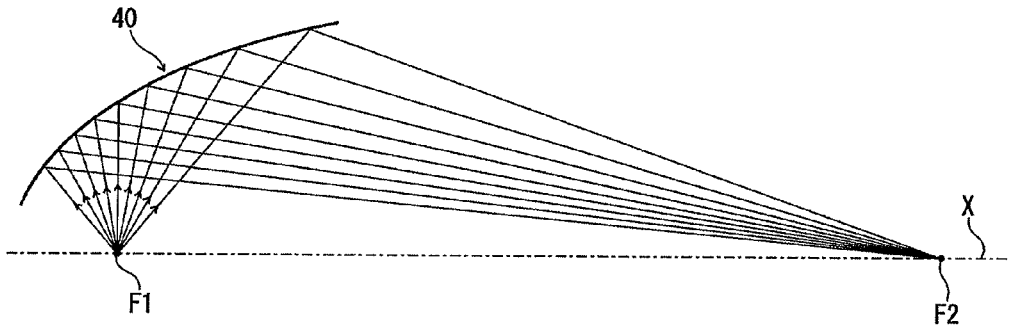
FIG. 7 is a light ray tracing diagram showing a plurality of light rays emitted from a first focal point on an elliptical surface reflecting mirror at equiangular intervals.
Figure 8:
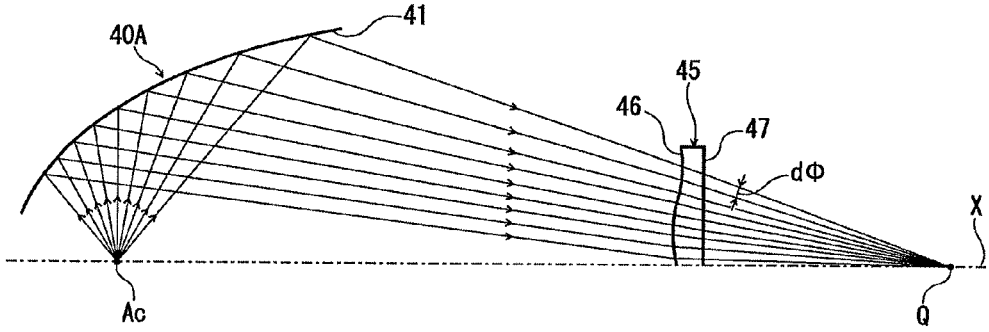
FIG. 8 is an explanatory view showing a rough configuration of an example related art optical device along with light ray tracings of light emitted from a discharge lamp.

The aspherical lens is not limited to a lens that exhibits a light condensing characteristic. As shown in; for instance, FIG. 6A, the aspherical lens can be embodied as a lens 30B that exhibits a collimating characteristic. Alternatively, as shown in FIG. 6B, the aspherical lens can be embodied as a lens 30A that exhibits a diverging characteristic. For instance, when the aspherical lens 30A exhibiting a collimating characteristic is used, the arc images on the light incident surface of the optical member; for instance, an integrator lens, can be made to assume a substantially equal luminous flux diameter. Hence, the light going outside the light incident surface of the integrator lens disappears, so that the use efficiency of light is enhanced. As a result, high illuminance can be achieved.

Moreover, the high pressure discharge lamp included in the optical device of the present invention is not limited to an ultra high pressure mercury lamp. For instance, a short-arc xenon lamp, can be used.

What is claimed is:

1. An optical device comprising:

a high pressure discharge lamp;

a concave condensing mirror that is placed so as to surround the high pressure discharge lamp while an optical axis of the concave condensing mirror stays extended along a direction of an arc of the high pressure discharge lamp; and an aspherical lens that is placed forward a light exit direction of the concave condensing mirror and that is rotationally symmetrical with respect to the optical axis of the concave condensing mirror, wherein:

a reflecting surface of the concave condensing mirror is configured to have a shape set in connection with a shape of a light incident surface and a shape of a light exit surface of the aspherical lens in such a way that there is exhibited an outgoing light distribution in which a ray density of light rays from an arc center (hereinafter called as "arc center light rays") becomes minimum at a position on the light exit surface of the aspherical lens where the light ray, which undergoes reflection at a reflecting position perpendicular to the optical axis of the concave condensing mirror passing through the arc center of the high pressure discharge lamp, exits out of the light exit surface of the aspherical lens and the ray density of the arc center light rays becomes greater with an increasing distance from the position toward a brim of the aspherical lens and a center axis of the asperical lens, thereby obtaining the outgoing light distribution in which an arc image becomes minimum at the position on the light exit surface of the aspherical lens where the light ray, which undergoes reflection at the reflecting position perpendicular to the optical axis of the concave condensing mirror passing through the arc center of the high pressure discharge lamp, exits out of the light exit surface of the aspherical lens, and the arc image becomes greater with the increasing distance from the position toward the brim of the aspherical lens and the center axis of the same.

2. The optical device according to claim 1, wherein:

provided that an angle which a direction of a light ray traveling from the arc center of the high pressure discharge lamp toward an arbitrary reflecting position on the reflecting surface of the concave condensing mirror forms with the optical axis of the concave condensing mirror is θ, the outgoing light distribution appearing on the light exit surface of the aspherical lens is that the ray density of the arc center light rays changes with sin θ in such a way that the ray density of the arc center light rays becomes greater with the increasing distance from the position where the ray density of the arc center light rays becomes minimum toward the brim of the aspherical lens and the center axis of the same, whereby the arc image change with sine in such a way that the arc image becomes greater with the increasing distance from the position where the arc image becomes minimum toward the brim of the aspherical lens and the center axis of the same.

3. The optical device according to claim 1, wherein:

the reflecting surface of the concave condensing mirror is formed by a plurality of micro surface constituting reflectors continually placed at angles respectively set with respect to the optical axis of the concave condensing mirror.

4. The optical device according to claim 3, wherein:

the micro surface constituting reflectors forming the reflecting surface of the concave condensing mirror are 1000 or more.

* * * * *